US009222754B2

(12) United States Patent
Lupher et al.

(10) Patent No.: US 9,222,754 B2
(45) Date of Patent: Dec. 29, 2015

(54) PRECISION GUIDED FIREARM WITH HYBRID SENSOR FIRE CONTROL

(71) Applicants: John Hancock Lupher, Austin, TX (US); Stefanie Kwan, Cedar Park, TX (US); Douglas Ainsworth Scott, Bracknell (GB); Michael Toal, Austin, TX (US)

(72) Inventors: John Hancock Lupher, Austin, TX (US); Stefanie Kwan, Cedar Park, TX (US); Douglas Ainsworth Scott, Bracknell (GB); Michael Toal, Austin, TX (US)

(73) Assignee: TrackingPoint, Inc., Pflugerville, TX (US)

( * ) Notice: Subject to any disclaimer, the term of this patent is extended or adjusted under 35 U.S.C. 154(b) by 96 days.

(21) Appl. No.: 13/913,353

(22) Filed: Jun. 7, 2013

(65) Prior Publication Data

US 2014/0360081 A1 Dec. 11, 2014

(51) Int. Cl.

| | |
|---|---|
| ***F41G 1/38*** | (2006.01) |
| ***F41G 3/12*** | (2006.01) |
| *F41G 3/08* | (2006.01) |
| *F41G 3/16* | (2006.01) |
| *F41G 3/06* | (2006.01) |

(52) U.S. Cl.

CPC .. *F41G 1/38* (2013.01); *F41G 3/12* (2013.01); *F41G 3/06* (2013.01); *F41G 3/08* (2013.01); *F41G 3/165* (2013.01)

(58) Field of Classification Search

CPC ..... F41G 3/08; F41G 3/02

USPC ..... 42/111–114, 117, 119, 135; 89/41.17; 235/407, 404

See application file for complete search history.

(56) References Cited

U.S. PATENT DOCUMENTS

| | | | | |
|---|---|---|---|---|
| 5,822,713 | A * | 10/1998 | Profeta | 701/302 |
| 5,974,940 | A * | 11/1999 | Madni et al. | 89/41.17 |
| 7,404,268 | B1 * | 7/2008 | Page | 42/137 |
| 8,989,449 | B2 * | 3/2015 | Backlund et al. | 382/107 |
| 2006/0005447 | A1 | 1/2006 | Lenner et al. | |
| 2012/0037702 | A1 | 2/2012 | Kude | |
| 2012/0297658 | A1 * | 11/2012 | Lupher et al. | 42/69.01 |
| 2013/0286239 | A1 * | 10/2013 | Lupher et al. | 348/222.1 |
| 2013/0298438 | A1 * | 11/2013 | Lowrey, III | 42/69.01 |
| 2014/0028856 | A1 * | 1/2014 | Ehrlich | 348/169 |
| 2014/0360072 | A1 * | 12/2014 | Lupher et al. | 42/69.01 |
| 2014/0360081 | A1 * | 12/2014 | Lupher et al. | 42/120 |

FOREIGN PATENT DOCUMENTS

WO 2011096854 8/2011

OTHER PUBLICATIONS

European Search Report, EP14171505, Sep. 30, 2014.

* cited by examiner

*Primary Examiner* — Reginald Tillman, Jr.

(74) *Attorney, Agent, or Firm* — Cesari & Reed LLP; R. Michael Reed

(57) ABSTRACT

A precision guided firearm (PGF) includes a trigger assembly and an optical device coupled to the trigger assembly. The optical device includes an optical sensor configured to capture video of a view area and includes at least one motion sensor. The optical device is configured to process video frames of the video to determine a distance between an aim point of the PGF and a selected location on a target and to determine a trajectory of the aim point based on the video frames and motion data from the at least one motion sensor.

18 Claims, 4 Drawing Sheets

PRECISION GUIDED FIREARM WITH HYBRID SENSOR FIRE CONTROL

FIELD

The present disclosure is generally related to small arms firearms, and more particularly to small arms firearms including an optical device configured to control timing of discharge of the small arms firearm.

BACKGROUND

When a user shoots a small arms firearm at a target at long range, small movements and/or user jitter may cause the aim point of the firearm to move relative to the target. Such movements may cause the aim point to be on target only briefly as the user attempts to control the aim point. Further, small changes in the minute of angle (MOA) relative to the target may cause a user to miss the target. At 1000 yards, a change of one MOA may cause the shooter to miss by as much as 10 inches.

A precision guided small arms firearm (PGF) is a weapon, such as a pistol, rifle, air gun, or other hand-held projectile-firing weapon that includes a controller configured to help the shooter hit a target. In the hands of different users, the characteristics of the movement of the firearm when directing the aim point of the firearm toward the selected target may vary significantly. For example, some shooters may change the direction and orientation of the aim point abruptly, making it difficult for the controller to enhance the shooter's accuracy.

SUMMARY

In an embodiment, a precision guided firearm (PGF) includes a trigger assembly and an optical device coupled to the trigger assembly. The optical device includes an optical sensor configured to capture video of a view area and includes at least one motion sensor. The optical device is configured to process video frames of the video to determine a distance between an aim point of the PGF and a selected location on a target and to determine a trajectory of the aim point based on the video frames and motion data from the at least one motion sensor.

In another embodiment, a method of controlling discharge of a PGF includes processing video frames of a video of an optical scope of the PGF to determine a distance between an aim point of the PGF and a selected location on a target within the video frames. The method further includes measuring movement of the PGF using at least one motion sensor of the optical scope and determining a shot time when the distance is less than a threshold distance from the selected location.

In still another embodiment, an optical scope includes at least one motion sensor configured to produce motion data corresponding to movement of the optical scope and an optical sensor configured to capture video of a view area. The optical scope further includes a processor coupled to the optical sensor and the motion sensor. The processor is configured to process video frames of the video and the motion data to determine when an aim point is less than a threshold distance from a selected location on a target.

BRIEF DESCRIPTION OF THE DRAWINGS

In the following discussion, the same reference numbers are used in the various embodiments to indicate the same or similar elements.

DETAILED DESCRIPTION OF ILLUSTRATIVE EMBODIMENTS

In the following detailed description of the embodiments, reference is made to the accompanying drawings which form a part hereof, and in which are shown by way of illustration of example embodiments. It is to be understood that features of the various described embodiments and examples may be combined, other embodiments may be utilized, and structural changes may be made without departing from the scope of the present disclosure.

Embodiments of a small arms (or hand-held) PGF are described below that includes a controller configured to control a trigger assembly to prevent discharge of a firearm until the aim point is within a threshold distance from a selected location on a target. Further, the controller is configured to process video frames of a sequence of video frames to optically track movement of the aim point relative to the selected location on the target. Additionally, the controller includes one or more motion sensors configured to determine changes in the acceleration, orientation, and inclination of the PGF to determine movement of the aim point during periods of time that fall between the video frames. In a particular example, the video frame rate is approximately 1 frame per 18.5 milliseconds, leaving blank or "dark" periods between video frames, during which time a user may change the trajectory of the aim point. The controller is configured to determine when the aim point is within a pre-determined threshold distance from the selected location on the target and to monitor the motion data from the one or more motion sensors to fill in the gaps between the video frames. This allows the controller to determine the trajectory of the aim point with a high level of precision. In particular, though motion sensors are susceptible to drift, such sensors may be effectively re-calibrated optically with each video frame, enhancing the accuracy of the motion sensors and allowing the controller to determine the trajectory with greater precision than if only optical sensors or motion sensors were used. In a particular embodiment, the controller may prevent discharge of the PGF until the aim point is within a threshold distance of a selected location on a target and until the aim point begins to move away from the selected location, even if such movement occurs between video frames. In an embodiment, the optical scope may communicate a control signal to a trigger assembly of the PGF to control timing of discharge of a bullet from the PGF to correspond to the time when the aim point begins to move away from the selected location. One possible example of a PGF according to an embodiment is described below.

Figure 1:
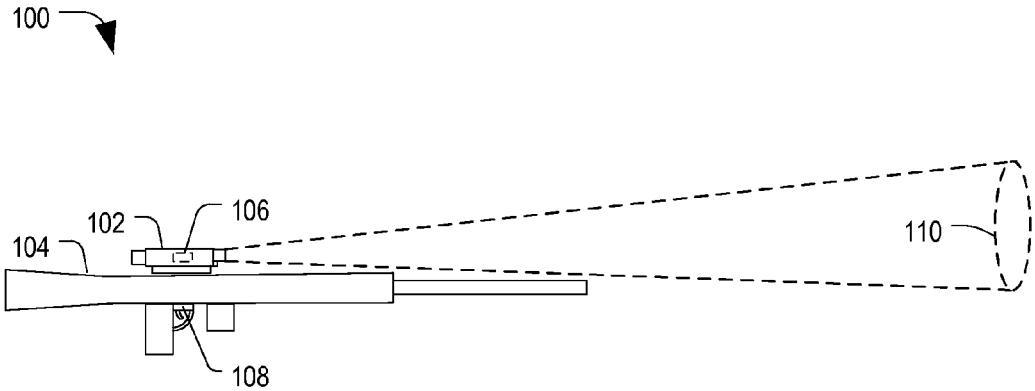
FIG. 1 is a diagram of a PGF according to an embodiment.

FIG. 1 is a diagram of a PGF 100 according to an embodiment. The PGF 100 includes an optical scope 102 mounted to a firearm 104. Optical scope 102 includes circuitry 106 that is communicatively coupled to a trigger assembly 108 through a wired or wireless connection to control timing of the discharge of firearm 104. Optical scope 102 includes optics coupled to optical sensors configured to capture video of a view area 110.

In an embodiment, the circuitry 106 may be configured to receive a user input indicating a selected target within view area 110. Upon receipt of the user input, circuitry 106 may apply a visual marker or tag on a selected location on the target in a display within optical scope 102, where the selected location corresponds to a visual aim point of the optical device at the time the user input is received. Upon selection of the target, circuitry 106 may also control a range finder, such as a laser range finder to determine a distance to the selected target. Upon determination of the distance, circuitry 106 may determine a ballistic solution for the selected target and adjust the display to show the portion of the view area corresponding to the current shot location based on the ballistic solution. The ballistic solution may include bullet drop, wind, muzzle velocity, and other parameters that may affect the impact location of the bullet when the firearm is discharged. The resulting aim point corresponds to the ballistic solution. This means that the view area seen by the user in the display of the optical scope 102 may dramatically change, including a complete shift from even having the target within the view area, due to the implementation of the ballistic solution. Accordingly, once the ballistic solution is determined, the center of the display within optical scope 102 may shift to correspond to a calculated impact location for the bullet when the firearm is discharged if no change was made by the user in the aim point of firearm 104.

Circuitry 106 may process each frame of video captured by optical sensors within optical scope 102 to determine changes in the aim point relative to the location on the selected target. Circuitry 106 may track the changes and predict when the aim point is within a pre-determined threshold (defining a minute of angle relative to the location on the selected target). In an embodiment, a minute of angle corresponds to a deviation of up to one inch per 100 yards from a selected location on a target. In one possible embodiment, optical scope 102 may include one or more user-selectable elements (such as buttons) that a user may interact with to adjust the threshold.

Further, circuitry 106 includes motion sensors configured to determine changes in the velocity and direction of the aim point. It should be understood that the optical scope captures video frames at a frame rate, such as 60 frames per second, 30 frames per second, or some other frame rate, and circuitry 106 processes the video frames to optically determine the trajectory of the aim point relative to the selected target. However, between frames, there exists a "black" area, "dark period" or "unknown" trajectory that may vary according to the user's movement. Circuitry 106 may capture measurements from the motion sensors during periods of time between video frames to determine relative movement of the aim point of the PGF 100. In a particular example, a shooter may change direction rapidly during the "dark" period between video frames, which could affect the accuracy of a shot if the change of direction is sufficiently large. However, the motion sensors may be used to determine the trajectory of the aim point during these "dark periods", calibrated from the optically determined aim point of the most recent frame and re-calibrated by optically processing a next video frame, such that any changes in the aim point, including abrupt changes, may be captured even before the next video frame. This allows circuitry 106 to accurately track the user's movement of the aim point into and through the "kill zone", which corresponds to threshold distance around the selected location on the target. Circuitry 106 may be configured to communicate a control signal to trigger assembly 108 to permit discharge of firearm 104 when the aim point is within a threshold distance of the selected location on the target.

Human jitter and muscle movements when the user is aiming the PGF 100 may cause the aim point to move relative to the selected location on the target. At high magnification, such movements and jitter are magnified relative to the selected location on the target. One example depicting the changing aim point of the PGF 100 is described below with respect to FIG. 2.

Figure 2:
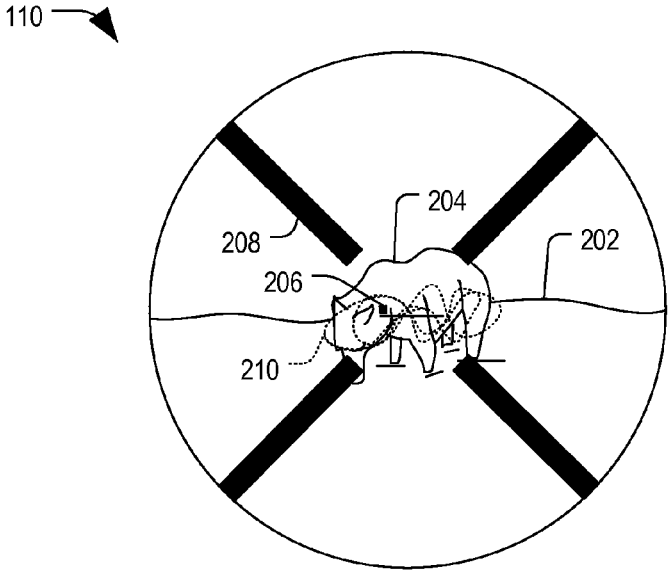
FIG. 2 is a diagram of a representative example of a view area of an optical scope of the PGF of FIG. 1.

FIG. 2 is a diagram of a representative example of a view area 110 of an optical scope 102 of the PGF 100 of FIG. 1. View area 110 includes a horizon 202 and a target 204 within view area 110. In this example, the user selected target 204, applying a visual marker 206 to the selected target 204 within a display of optical scope 102. View area 110 further includes a reticle 208, which shows the aim point of the optical scope 102 at the center of the reticle. The change in the alignment of the center of the reticle or the aim point over time is represented by dashed line 210, which crosses back and forth over target 204 as the user attempts to aim PGF 100 at the selected location (represented by visual marker 206).

In an embodiment, the user selects the target, for example, by interacting with one or more buttons on the trigger assembly 108, on optical scope 102, or any combination thereof, while aiming PGF 100 toward the target. In response to a user input signal corresponding to the user's interaction, circuitry 106 applies visual marker 206, within a display of the optical scope 102. After application of the visual marker, optical scope 102 determines a distance to the selected location on the target (for example, using laser range finding circuitry) and calculates a ballistic solution, which may cause the optical scope to adjust the presentation of the view area in the display to align the center of the view area (and the corresponding reticle) to the ballistic solution, accounting for bullet drop and other factors. Thus, when the shooter directs the PGF 100 toward the target, the center of the reticle corresponds to the ballistic solution.

Circuitry 106 processes each video frame to monitor the changes in the aim point from one frame to the next. Further, circuitry 106 monitors motion data to determine changes in the trajectory of the aim point between video frames. In an embodiment, circuitry 106 may monitor the motion data to determine when the aim point reaches its closest approach to the selected location on the target. In one particular implementation, the closest approach may be detected when the aim point is within the threshold distance from the selected location on the target and the aim point begins to move away from the selected location on the target. Optical scope 102 controls timing of the discharge of PGF 100 to discharge when the closest approach is detected. Thus, circuitry 106 allows discharge when the aim point is within a pre-determined threshold distance (where the distance corresponds to the minute of angle of error of the aim point of the target) from the selected location on the target (represented by visual marker 206) and when the distance between the aim point and the selected location is increasing as determined from the motion sensors relative to the optically determined aim point location within the most recent video frame.

Figure 3:
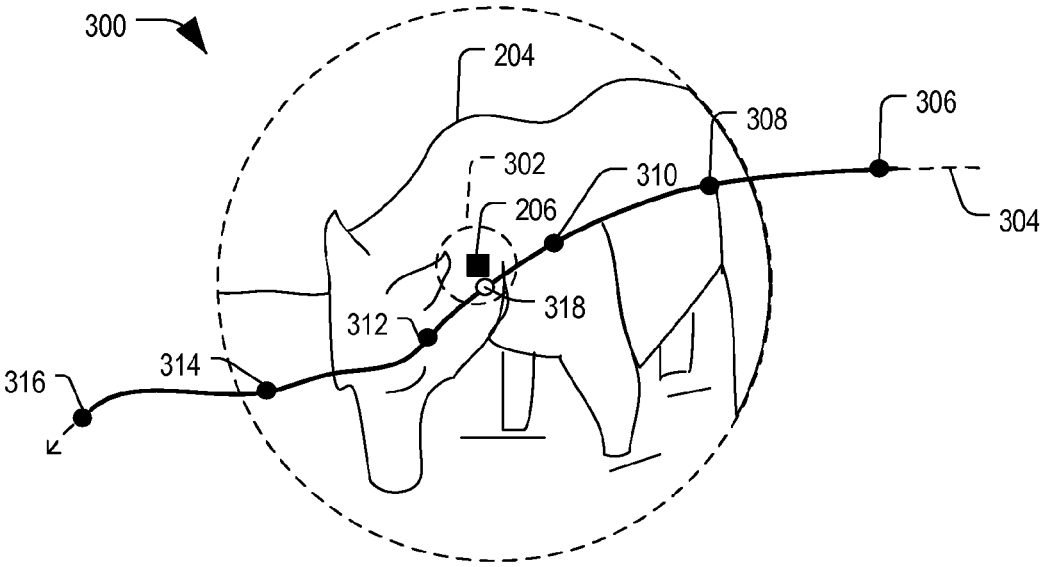
FIG. 3 is a diagram of an expanded portion of the view area of FIG. 2.

FIG. 3 is a diagram of an expanded portion 300 of the view area 110 of FIG. 2. Expanded portion 300 depicts target 204 and visual marker 206. Further, expanded portion 300 depicts a "kill area" or threshold distance 302 relative to visual marker 206 within which circuitry 106 of optical scope 102 will permit trigger assembly 108 to discharge PGF 100. In an embodiment, a default threshold distance 302 may be one MOA at 1000 yards (which MOA represents one inch of deviation per 100 yards), and the user may adjust the threshold distance 302 from that default. The threshold distance 302 may be programmed by a user by interacting with a user interface of optical scope 102 or by interacting with an interface of a smart phone or other computing device configured to communicate with optical scope 102 through a wired or wireless communication link. The threshold distance 302 may be defined in inches, centimeters, or minutes of angle. Further, optical scope 102 may be configured to adjust the threshold distance 302 based on the level of zoom of the optical scope 102 and the target 204.

In the illustrated example, the aim point follows a path 304, which passes through the "kill area" defined by the threshold distance 302. Circuitry 106 captured optical samples from video frames at 306, 308, 310, 312, 314 and 316 and aim point changes over time. In this example, video frames 310 and 312 fall outside of and on either side of the "kill zone" represented by threshold distance 302. Optics-only based prediction of the time at which the aim point will pass near selected location 206 and within threshold distance 302 is represented at 318. In this instance, such a prediction would be sufficient to hit the selected target because the aim point continues on a relatively consistent path. However, in some instances, a user may abruptly change direction due to a muscle twitch or an attempt to align the reticle of the optical scope 102, which abrupt change may cause the predicted location 318 to be inaccurate. By utilizing motion data during the time periods between video frames, such as between video frames 310 and 312, the motion data may confirm the continuing trajectory allowing optical scope 102 to control trigger assembly 108 to discharge firearm 104 at a point corresponding to 318. Alternatively, the motion data may be used to detect an abrupt change in trajectory, causing optical scope 102 to control trigger assembly 108 to alter the shot timing or to continue to prevent discharge, depending on the timing of the change in motion. One possible example of the effect of such an abrupt change is described below with respect to FIG. 4.

Figure 4:
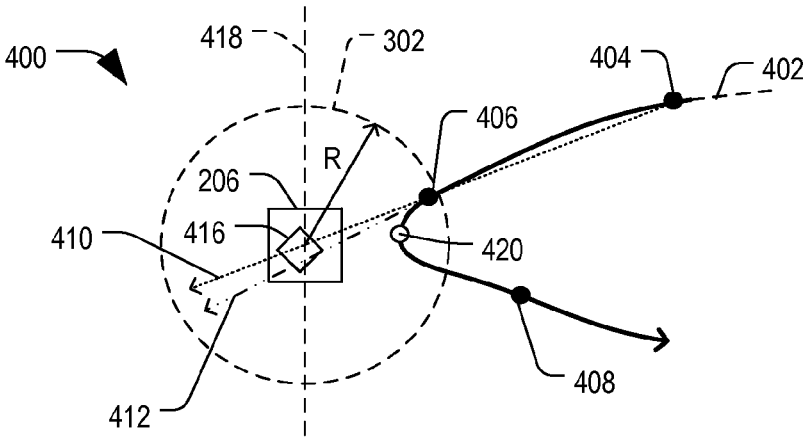
FIG. 4 is diagram of a representative example of a path of an aim point of the PGF of FIG. 1 as a user directs the aim point toward and away from a selected target.

FIG. 4 is diagram of a representative example 400 of a path 402 of an aim point of the PGF 100 of FIG. 1 as a user directs the aim point toward and away from a selected target over time. Example 400 includes visual marker 206 and threshold distance 302. Further, example 400 depicts visual samples 404, 406, and 408, which may be separated by regular time intervals (the frame rate) as the aim point moves along the path 402 toward and away from the target 204. In this particular example, path 402 is directed toward the selected location 206 at video frames 404 and 406. An optics-only prediction from 404 through 406 and assuming a straight path would follow phantom line 410 through visual marker 206, crossing a center line that intersects visual marker 206. An optics and motion sensor prediction that relied on an assumed trajectory following the last optical sample might predict a slightly different trajectory, such as that depicted by line 412, which also intersects visual marker 206. In either example, optical scope 102 would control trigger assembly 108 to discharge PGF 100 at a point along the predicted path corresponding to a predicted discharge point 416, which would be just after the aim point begins to move away from selected location 206.

In embodiments described herein, circuitry 106 uses the motion data to detect that the aim point is changing direction. In this instance, circuit 106 may determine that the aim point trajectory changed shortly after video frame 406 and before video frame 408. At video frame 406, circuitry 106 determines that the aim point is within the threshold distance 302 and determines that the aim point is moving away from selected location 206 at point 420, causing circuitry 106 to control trigger assembly 108 to discharge PGF 100 at the moment corresponding to point 420 along path 402, thereby hitting the target within the kill zone (i.e., within the threshold distance 302 from the selected location (corresponding to visual marker 206) on the target).

It should be appreciated that circuitry 106 may capture visual frames at a constant rate (i.e., a video frame rate), but the velocity of the change in the aim point of PGF 100 and the directional vector of the aim point may vary over time. Thus, video frames may be spaced unevenly along the path 402 of the aim point as the user changes direction, accelerates in one direction and so on. By combining motion sensor data with optical data derived from each video frame, the motion sensors of circuitry 106 are effectively recalibrated optically with each video frame such that the movement data may be used to determine the actual trajectory of the aim point between video frames.

Figure 5:
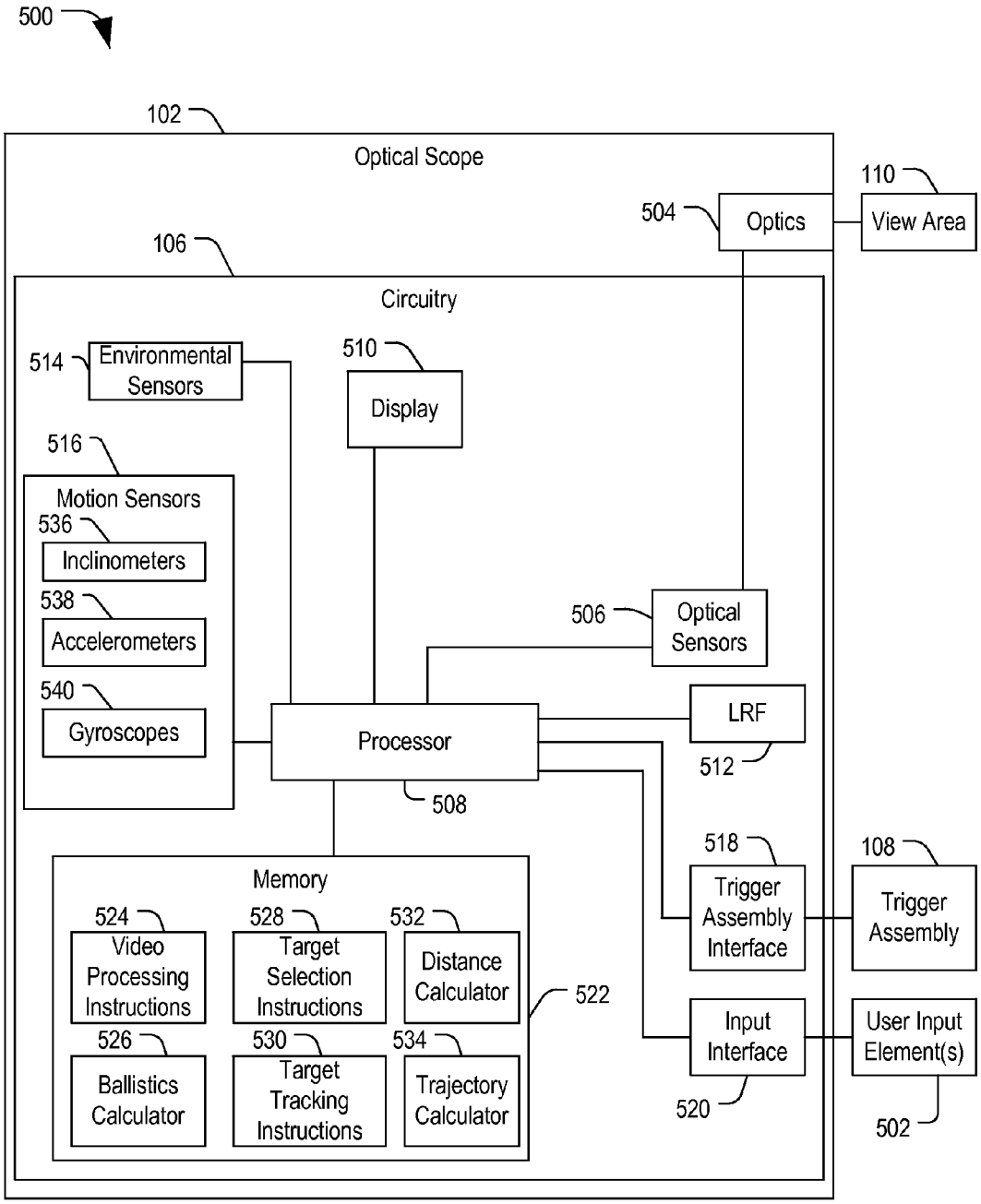
FIG. 5 is a block diagram of a PGF according to an embodiment.

FIG. 5 is a block diagram of a PGF 500 according to an embodiment. In an example, PGF 500 is one possible implementation of PGF 100 of FIG. 1. PGF 500 includes optical scope 102 including circuitry 106 coupled to trigger assembly 108. Further, circuitry 106 is coupled to user input elements 502 to receive user inputs.

Optical scope 102 includes optics 504 configured to focus light from view area 110 toward one or more optical sensors 506 of circuitry 106, which optical sensors 506 are configured to capture video of view area 110. Circuitry 106 includes a processor 508 coupled to optical sensor(s) 506. Circuitry 106 further includes a display 510 coupled to processor 508, which is configured to provide video to display 510. Circuitry 106 further includes a laser range finder (LRF) 512 coupled to processor 508. LRF 512 is controlled by processor 508 to direct a focused beam toward a selected target, and optical sensor 506 may receive a reflected version of the focused beam. Processor 508 or LRF 512 may calculate a distance to the selected target based on the reflected version of the focused beam.

Circuitry 106 further includes environmental sensors 514 coupled to processor 508, which environmental sensors 514 may be configured to measure temperature, humidity, air pressure, and other environmental parameters. Circuitry 106 also includes one or more motion sensors 516, including gyroscopes 540, accelerometers 538, inclinometers 536, and other sensors (not shown) configured to detect mechanical motion of optical device 102. Motion sensor(s) 516 are coupled to processor 508, which is also coupled to a memory 522. Motion sensors 516 may include one or more inclinometers 536, one or more accelerometers 538, one or more gyroscopes 540, other motion sensors, or any combination thereof. In a particular example, motion sensors 516 may include a micro-electro-mechanical system (MEMS) configured to detect motion and directional data corresponding to optical scope 102, which is aligned to firearm 104.

Further, circuitry 106 may include an altimeter and other sensors configured to determine the altitude at which optical scope 102 is being used. Circuitry 106 also includes a trigger assembly interface 518 coupled to processor 508 and coupled to trigger assembly 108 to provide control signals to trigger assembly 108 to control timing of discharge of PGF 500. Circuitry 106 further includes an input interface 520 coupled to processor 508 and coupled to one or more user input elements 502, such as buttons or switches on trigger assembly 108, on a housing of optical scope 102, or any combination thereof. The user may interact with user input elements 502 to adjust various parameters including, but not limited to, adjustments to the threshold distance, adjustments to various settings (such as wind speed and direction), adjustments to visual parameters, such as the shape and orientation of the reticles or the visual marker, and so on. Additionally, the user may interact with the user input elements 502 to tag a target and/or adjust a zoom setting. Other parameters and user selection options may also be accessible through the user input elements 502.

Memory 522 stores instructions that, when executed by processor 508, cause processor 508 to perform a variety of functions and operations. Memory 522 includes video processing instructions 524 that, when executed, cause processor 508 to process video frames from optical sensors 506 for presentation to display 510. Further, video processing instructions 524 cause processor 508 to determine the aim point of the optical device 102 relative to view area 110.

Memory 522 further stores a ballistics calculator 526 that, when executed, causes processor 508 to determine the aim point of PGF 500 based on environmental parameters from environmental sensors, based on motion sensors 516, and based on the distance determined using LRF 512. Memory 522 also includes target selection instructions 528 that, when executed, cause processor 508 to receive user input from input interface 520 and to adjust one or more settings and/or select a target in response to the user input and to place a visual marker on a selected location on a target that corresponds to the user input. Memory 522 further includes target tracking instructions 530 that, when executed, cause processor 508 to maintain the visual marker at the selected location on the target within the video frames in the display 510.

Memory 522 further includes a distance calculator 532 that, when executed, causes processor 508 to calculate an X-Y distance from the aim point in each video frame to the selected location on the target within the frame. Memory 522 also includes a trajectory calculator 534 that, when executed, causes processor 508 to determine a trajectory of a changing aim point by optically processing video frames and by including motion data from motion sensors 516 during periods between video frames to determine the trajectory of the aim point. Trajectory calculator 534 causes processor 508 to provide a control signal to trigger assembly 108 through trigger assembly interface 518 to control timing of the discharge of PGF 500 when the distance between the aim point and the selected location on the target is less than the threshold distance and the motion sensor data indicates that the aim point is moving away from the selected location.

Figure 6:
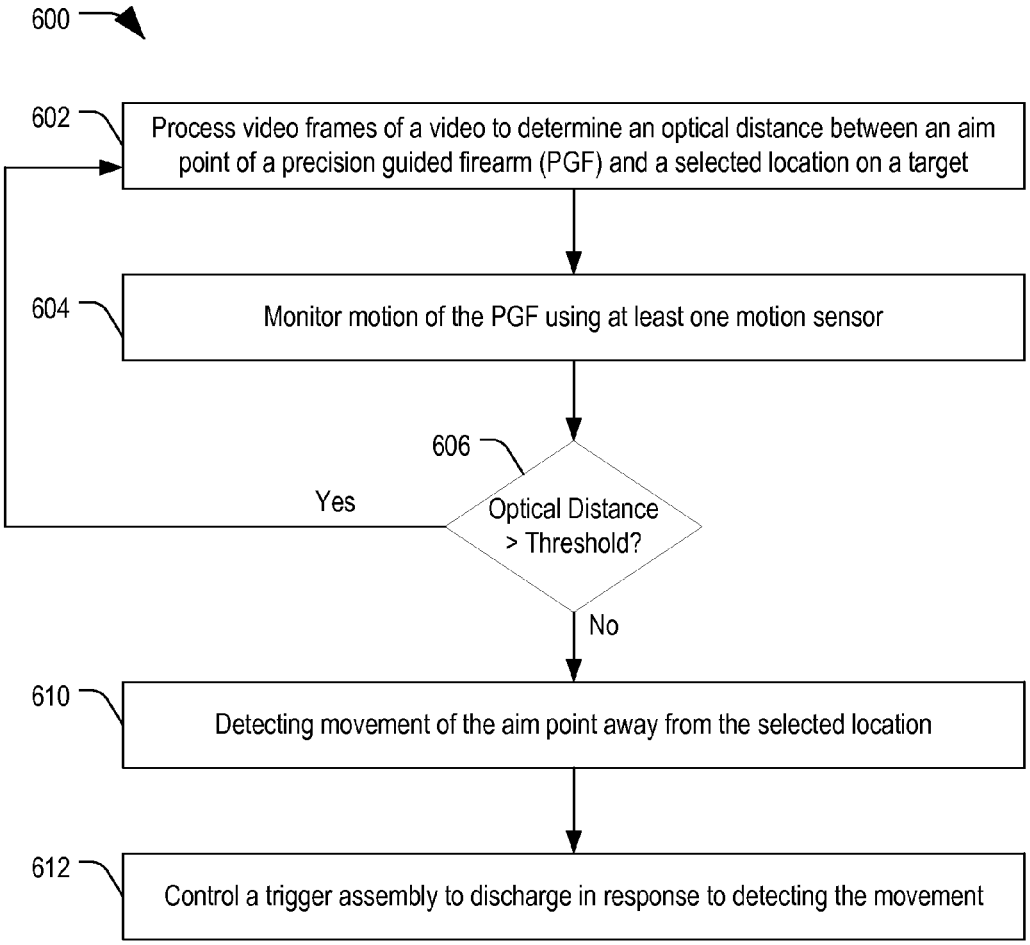
FIG. 6 is a flow diagram of a method of discharging a PGF in response to determining a closest approach.

FIG. 6 is a flow diagram of a method 600 of discharging a PGF in response to determining a closest approach. At 602, a processor of an optical scope processes video frames of a video to determine an optical distance between an aim point of a PGF and a selected location on a target. The aim point of the PGF refers to the aim point that corresponds to the ballistic solution. The distance is an X-Y optical distance between the aim point and a center of a selected location on the target measured optically in the video frames.

Advancing to 604, the processor monitors motion of the PGF using at least one motion sensor. In an example, the motion sensor includes one or more accelerometers, one or more inclinometers, one or more gyroscopes, other motion sensors, or any combination thereof. In a particular example, the motion sensors 516 in FIG. 5 may be implemented using a micro-electro-mechanical system configured to detect motion data.

Continuing to 606, if the optical distance is greater than the threshold distance, the method returns to 602 to process a next video frame. In this example, the aim point of the PGF would be outside of the kill zone (outside of the threshold distance 302), so optical scope 102 would not enable discharge of trigger assembly 108. At 606, if the optical distance is less than the threshold, then the aim point is within the kill zone (inside the threshold distance 302), so the optical scope 102 is in a state in which the trigger assembly 108 may be enabled or released. Method 600 advances to 610, and the processor detects movement of the aim point away from the selected location. Such movement may indicate that the trajectory of the aim point changed abruptly or that the aim point is beginning to move out of the kill zone (such as just after intersecting the selected location on the target). Once the processor detects movement of the aim point away from the selected location, method 600 advances to 612 and optical scope 102 controls trigger assembly 108 to discharge in response to detecting the movement of the aim point away from the selected location.

By preventing discharge of the firearm until the aim point is moving away from the selected location, optical scope 102 ensures that the PGF 100 won't fire until the user has achieved a closest approach to the selected location on the target. In other words, PGF 100 won't discharge at the point when the user first enters the "kill zone" but rather at the point when the distance between the aim point and the selected location has reached is local minima and is beginning to increase.

It should be appreciated that the "closest approach" is just one possible technique for hitting the target within an acceptable margin of error relative to the selected location on the target. In the closest approach technique, circuitry 106 controls timing of the discharge of the firearm to coincide with a time when the aim point will be within the threshold distance of the selected location and will be moving away from a line that intersects the selected location and that is perpendicular to the trajectory of the aim point. In another example, circuitry 106 may calculate when the aim point will reach the closest point and may cause trigger assembly 108 to discharge the firearm at the calculated time. In still another example, circuitry 106 may delay discharge for a pre-determined period of time after the aim point is within the threshold distance. Other strategies are also possible, depending on the implementation and the desired level of accuracy.

It is to be understood that, even though characteristics and advantages of the various embodiments have been set forth above, together with details of the structure and function of various embodiments, changes may be made in details, especially in the matters of structure and arrangement of parts within principles of the present disclosure to the full extent indicated by the broad meaning of the terms in which the appended claims are expressed. For example, while the description of PGF 500 includes an input interface 520 that is coupled to user selectable elements 502, such elements may be located on a housing of optical scope 102, on trigger assembly 108, or may be provided by a computing device (such as a portable computer, a tablet computer, a smart phone, and the like) that may communicate with input interface 520, or any combination thereof. Further, input interface 520 may include a wireless transceiver and/or a wired connection, such as a universal serial bus (USB) port to receive a connector associated with a computing device.

Further, the particular instruction sets may be combined into a single application or may be installed as modular instruction sets depending on the particular implementation for the PGF 500 while maintaining substantially the same functionality without departing from the scope and spirit of the disclosure. In addition, while the above-discussion focused on usage of a distance calculator to determine an optical distance between the aim point (corresponding to the ballistic solution of PGF 500) and a selected location on the target and usage of a closest approach predictor 534 to predict when the trajectory of the changing aim point will reach its closest approach, it is also possible to combine the distance calculator and predictor functions. It will be appreciated by those skilled in the art that the teachings disclosed herein can be carried out using measurements of velocity and changing acceleration from motion sensors and that timing of the prediction may include such measurements, effectively adjusting the timing of discharge of the firearm according to the measurements to account for a non-linear change in the velocity and direction of the aim point of PGF 500.

Although the present invention has been described with reference to preferred embodiments, workers skilled in the art will recognize that changes may be made in form and detail without departing from the scope of the invention.

What is claimed is:

1. A precision guided firearm (PGF) comprising:

a trigger assembly; and an optical device coupled to the trigger assembly and including an optical sensor configured to capture video of a view area and at least one motion sensor, the optical device configured to process video frames of the video to determine a distance between an aim point of the PGF and a selected location on a target and to determine a trajectory of the aim point based on the video frames and motion data from the at least one motion sensor, the optical device configured to provide a control signal to the trigger assembly to permit discharge of the firearm when the distance is less than a threshold and the trajectory of the aim point is moving away from the selected location.

2. The PGF of claim 1, further comprising a trigger assembly coupled to the optical device and responsive to a control signal from the optical device to permit discharge of the firearm.

3. The PGF of claim 1, wherein the at least one motion sensor measures movement between the video frames to determine changes in the trajectory.

4. The PGF of claim 3, wherein the optical device recalibrates the at least one motion sensor optically after processing at least some of the video frames.

5. The PGF of claim 1, wherein the optical device processes the video frames sequentially to determine changes in the distance between the aim point and the selected location on the target from one frame to a next frame.

6. The PGF of claim 1, wherein the optical device predicts the trajectory of the aim point based on the changes in the distance determined optically and refines the trajectory using the motion data.

7. The PGF of claim 1, wherein the at least one motion sensor comprises a micro-electro-mechanical system configured to capture inertial measurements to determine the motion data.

8. A method of controlling discharge of a precision guided firearm (PGF), the method comprising:

processing video frames of a video from one or more optical sensors of an optical scope of the PGF to determine a distance between an aim point of the PGF and a selected location on a target within the video frames;

measuring movement of the PGF using at least one motion sensor of the optical scope;

determining a shot time when the distance is less than a threshold distance from the selected location; and sending a control signal to a trigger assembly to enable discharge of the PGF in response to determining the shot time when an aim point of the PGF is moving away from the selected location.

9. The method of claim 8, wherein measuring the movement of the PGF comprises measuring the movement of the PGF during periods of time between video frames using at least one of an accelerometer, an inclinometer, and a gyroscope.

10. The method of claim 8, wherein the distance threshold corresponds to a minute of angle that is up to one inch of deviation per 100 yards relative to the selected location on the target.

11. The method of claim 8, further comprising wherein the threshold distance defines a zone within which a shot taken using the PGF will hit the target.

12. The method of claim 11, wherein the selected location is at a center of the zone.

13. A precision guided firearm (PGF) comprising:

a trigger assembly; and an optical scope including:

at least one motion sensor configured to produce motion data corresponding to movement of the optical scope;

an optical sensor configured to capture video of a view area; and a processor coupled to the optical sensor and the at least one motion sensor, the processor configured to process video frames of the video and the motion data to determine when an aim point is less than a threshold distance from a selected location on a target and is moving away from the selected location.

14. The PGF of claim 13, wherein the at least one motion sensor comprises at least one of an accelerometer, a gyroscope, and an inclinometer.

15. The PGF of claim 13, wherein the processor determines an initial trajectory of the aim point by processing sequential ones of the data frames to determine changes in the position of the aim point relative to the selected target.

16. The PGF of claim 15, wherein, during time periods between each of the video frames, the processor uses the motion data from the at least one sensor to determine a change in the distance relative to the selected location on the target.

17. The PGF of claim 13, further comprising:

an interface configurable to couple to a trigger assembly; and wherein the processor is configured to provide a firearm discharge control signal to enable the trigger assembly in response to determining when the aim point is less than the threshold distance from the selected location.

18. The PGF of claim 13, further comprising an input interface configurable to receive a user input, the user input corresponding to at least one of the selected location on the target and the threshold distance.

* * * * *